US007211755B1

(12) United States Patent
Wang et al.

(10) Patent No.: US 7,211,755 B1
(45) Date of Patent: May 1, 2007

(54) KNOB STRUCTURE

(75) Inventors: Chia-Ho Wang, Taipei (TW); Ching-Sen Hu, Sinjhuang (TW); Chi-Yen Chiang, Taipei (TW)

(73) Assignee: Micro-Star Int'l Co., Ltd., Taipei (TW)

( * ) Notice: Subject to any disclaimer, the term of this patent is extended or adjusted under 35 U.S.C. 154(b) by 0 days.

(21) Appl. No.: 11/485,357

(22) Filed: Jul. 13, 2006

(30) Foreign Application Priority Data

Dec. 23, 2005 (TW) ..... 94222562 U

(51) Int. Cl.
*H01H 19/00* (2006.01)

(52) U.S. Cl. ..... 200/336; 200/11 R; 200/564

(58) Field of Classification Search ..... 200/14, 200/11 R–11 TW, 564, 565, 568–571, 336, 200/310–317
See application file for complete search history.

(56) References Cited

U.S. PATENT DOCUMENTS 6,525,713 B1 * 2/2003 Soeta et al. ..... 345/160
6,525,714 B1 * 2/2003 Varga et al. ..... 345/164
6,876,313 B2 * 4/2005 Hsiung et al. ..... 341/35
7,014,330 B2 * 3/2006 Yokoyama et al. ..... 362/23
7,054,551 B2 * 5/2006 Liao et al. ..... 396/299
7,060,916 B1 * 6/2006 Amit et al. ..... 200/11 R
7,061,720 B2 * 6/2006 Lin ..... 360/137

FOREIGN PATENT DOCUMENTS

JP 2002-110001 9/2000

* cited by examiner

*Primary Examiner*—Michael A. Friedhofer
(74) *Attorney, Agent, or Firm*—Reed Smith LLP; Stanley P. Fisher, Esq.; Juan Carlos A. Marquez, Esq.

(57) ABSTRACT

A knob structure is disposed on an electronic device to input a preset control signal. The knob structure includes a rotary encoder, a brake wheel, and a rotary wheel. A plurality of ratchets is disposed around the circumference of the brake wheel and locked on the rotary encoder. The rotary wheel is rotatably disposed on the body case of the electronic device and is nested on the brake wheel correspondingly. A block is disposed on the rotary wheel to be embedded between the ratchets, so as to control the rotation of the rotary wheel to generate a preset control signal by causing the brake wheel to drive the rotary encoder to rotate. The rotary wheel and the brake wheel are engaged non-fixedly, so as to prevent the rotary wheel and the body case of the electronic device from interfering with each other.

11 Claims, 9 Drawing Sheets

KNOB STRUCTURE

CROSS-REFERENCE TO RELATED APPLICATIONS

This non-provisional application claims priority under 35 U.S.C. § 119(a) on Patent Application No(s). 094222562 filed in Taiwan, R.O.C. on Dec. 23, 2005, the entire contents of which are hereby incorporated by reference.

BACKGROUND OF THE INVENTION

1. Field of Invention

The present invention relates to a knob structure, and particularly to a knob structure applied in an electronic device, wherein a preset control signal is input by rotating the knob structure.

2. Related Art

With the rapid popularity of multimedia technologies and applications, more and more types of portable electronic devices are appearing, such as mobile telephones, personal digital assistants (PDA), digital cameras, MP3 players, MPEG4 players, recording digital photo frames, and hand-held game players. Further, with continuous advancement of science and technology, those portable electronic devices are becoming smaller in volume to be carried more conveniently by users and more powerful in function to satisfy their requirements.

Regarding the MP3 player which is quite popular at present, the MP3 player comprises a main part at least comprising a display screen and a plurality of keys, wherein the display screen is used to display a list of songs, and a series of actions, such as enter, play, forward, and backward, may be performed through the keys. A user may operate the MP3 player more conveniently if there are more keys, but the volume of the MP3 player will become larger. On the other hand, if the number of the keys is small, though the volume of the MP3 player may be reduced, many operations will need to be performed by pressing two or three keys simultaneously, which complicates operation for the user.

In order to solve the problem that volume and convenience of operation conflict with each other, an electronic touch knob is applied in an iPod player introduced by Apple Computer Inc. The user may rotate the touch knob to send a corresponding preset command, and by using a menu operation interface, the user may conveniently perform actions such as enter, play, forward, or backward conveniently. The user may also use the touch knob to adjust sound volume. Through the design of the touch knob, the iPod can not only perform various functions easily, but also has a reasonably small volume. Through the design of the touch knob of the iPod, the user may rotate and slide the knob in a corresponding region in the body by a finger, which lacks the touch feeling the user may have when pressing the keys. In order to show response to the action of the user, a buzzer is added into the electrical part of the iPod and displayed through the display screen.

Similarly, in order to solve the problem that the convenience of operation and the volume conflict with each other, besides that the iPod employs the electronic touch knob, a mechanical knob structure may be disposed in the MP3 player. For example, a rotary component has been disclosed in Japan Patent No. 2000297077. The rotary component comprises a cabinet and a rotary body, wherein the rotary body may rotate on the cabinet and output a control signal. Referring to FIG. 1, it is a schematic view of a rotary component 41 applied in a MP3 player 53. A rotary wheel

42 is fixedly combined with the rotary component 41, and a through-hole 531 is perforated in the body case of the MP3 player 53 corresponding to the position of the rotary wheel 42. After the rotary component 41 and the rotary wheel 42 are installed on a circuit board 532 of the MP3 player 53, the through-hole of the body case is covered corresponding to the rotary wheel 42. Since a flange is disposed between the cabinet of the rotary component 41 and the rotary body, the user will feel fragmental tactility through the flange when operating the rotary wheel 42 to drive the rotary body to rotate. As such, the user may know whether the operation is performed through the physical tactility, so the buzzer demanded by the electronic touch knob is unnecessary.

For the MP3 player adopting the rotary component, during the practical production and assembly, the rotary component and the rotary wheel are firstly assembled on the circuit board and locked with the body case together. Among the rotary component, the rotary wheel, the through-hole in the body case, and the body itself has dimensional errors, and the dimensional errors are summed up when the components are assembled. The rotary wheel and the through-hole of the body will interfere with each other easily due to dimensional errors. As such, the user may feel it is inconvenient to operate due to the interference, and if the interference is serious, the MP3 player will be determined to be scraped.

Furthermore, the aforementioned rotary wheel does not have the function of light indication, so it is difficult for the user to operate when light is insufficient or at night. Further, at present, keys of a mobile phone are provided with a backlight source and when the user presses a press key, the backlight source is triggered to illuminate the position of the press key, such that the user can use the mobile phone conveniently. However, for the aforementioned rotary wheel, the luminescent design cannot be adopted due to the aforementioned interference.

SUMMARY OF THE INVENTION

According to one aspect of the invention, a knob structure is provided on an electronic device. The knob structure may comprise a rotary encoder, a plurality of light emitting sources, a light guiding ring, a brake wheel, and a rotary wheel.

Accordingly, it is an object of the invention to provide a knob structure in which the rotary wheel may smoothly rotate on the body case in a manner of non-fixed engagement to reduce the number of defective products and alleviate the problem of the interference, so as to greatly enhance the product yield and reduce the production cost.

Another object of the invention is to provide a knob structure which may provide the bright lights generated by the light emitting sources in an environment with insufficient lights or at night to indicate the position of the knob.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and thus are not limitative of the present invention, and wherein:

FIG. 5A is an exploded schematic view when the present invention is applied in an electronic device;

FIG. 5B is a assembly schematic view when the present invention is applied in an electronic device;

DETAILED DESCRIPTION OF THE INVENTION

The knob structure disclosed by the present invention is disposed on an electronic device and used to input a preset control signal. The so-called control signal refers to the signal input into the electronic device to perform an action, such as enter, play, forward, backward, and sound volume control, according to a pulse signal generated by the knob structure, wherein the electronic device refers to an electronic data processing device, such as a mobile telephone, a PDA, a digital camera, a MP3 player, a MPEG4 player, a recording digital photo frame, and a handheld game player. In the following detailed illustration about the present invention, a knob structure applied in a MP3 player will be illustrated as one preferred embodiment of the present invention.

Figure 1:
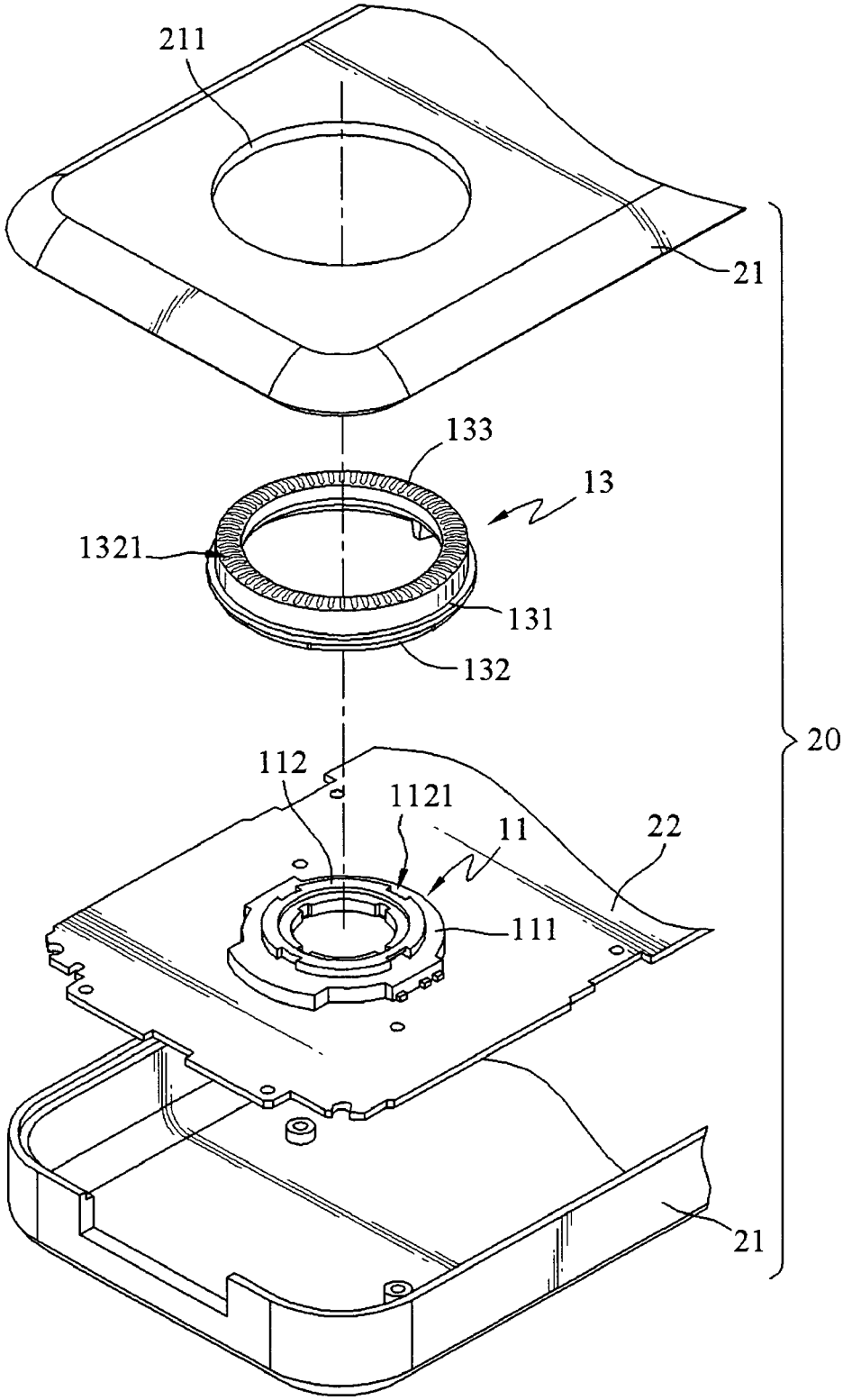
FIG.1(PRIOR ART)
FIG. 1 is a schematic view of a conventional knob structure applied in an electronic device.
Figure 2:
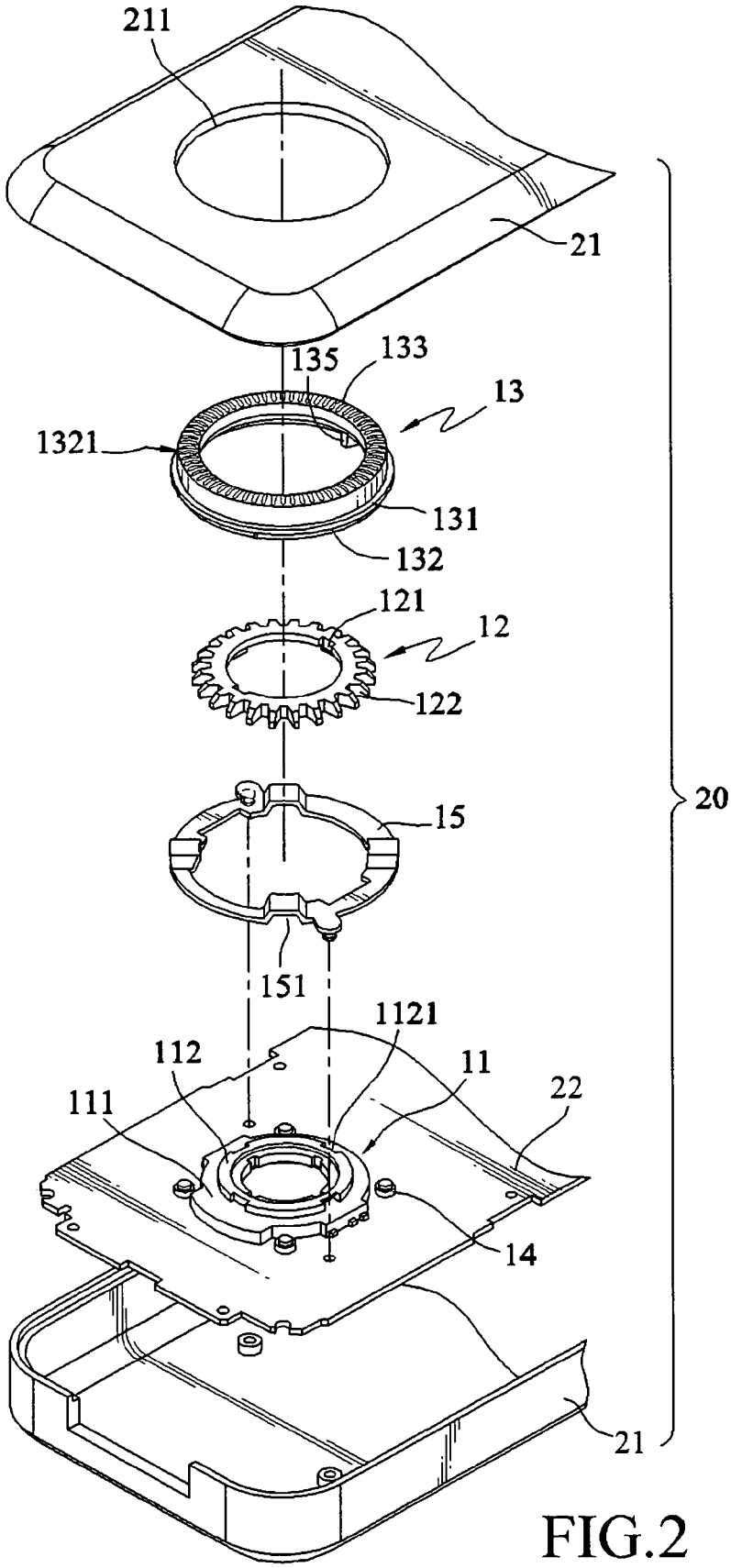
FIG. 2 is an exploded schematic view of the structure of one embodiment of the present invention.

Referring to FIG. 2, a light emitting knob structure of the present invention is applied in an electronic device 20, wherein the electronic device 20 is a MP3 player. The electronic device 20 at least comprises a body case 21 and a circuit board 22 with a plurality of electronic parts, wherein at least one round hole 211 is formed in the body case 21.

Figure 3:
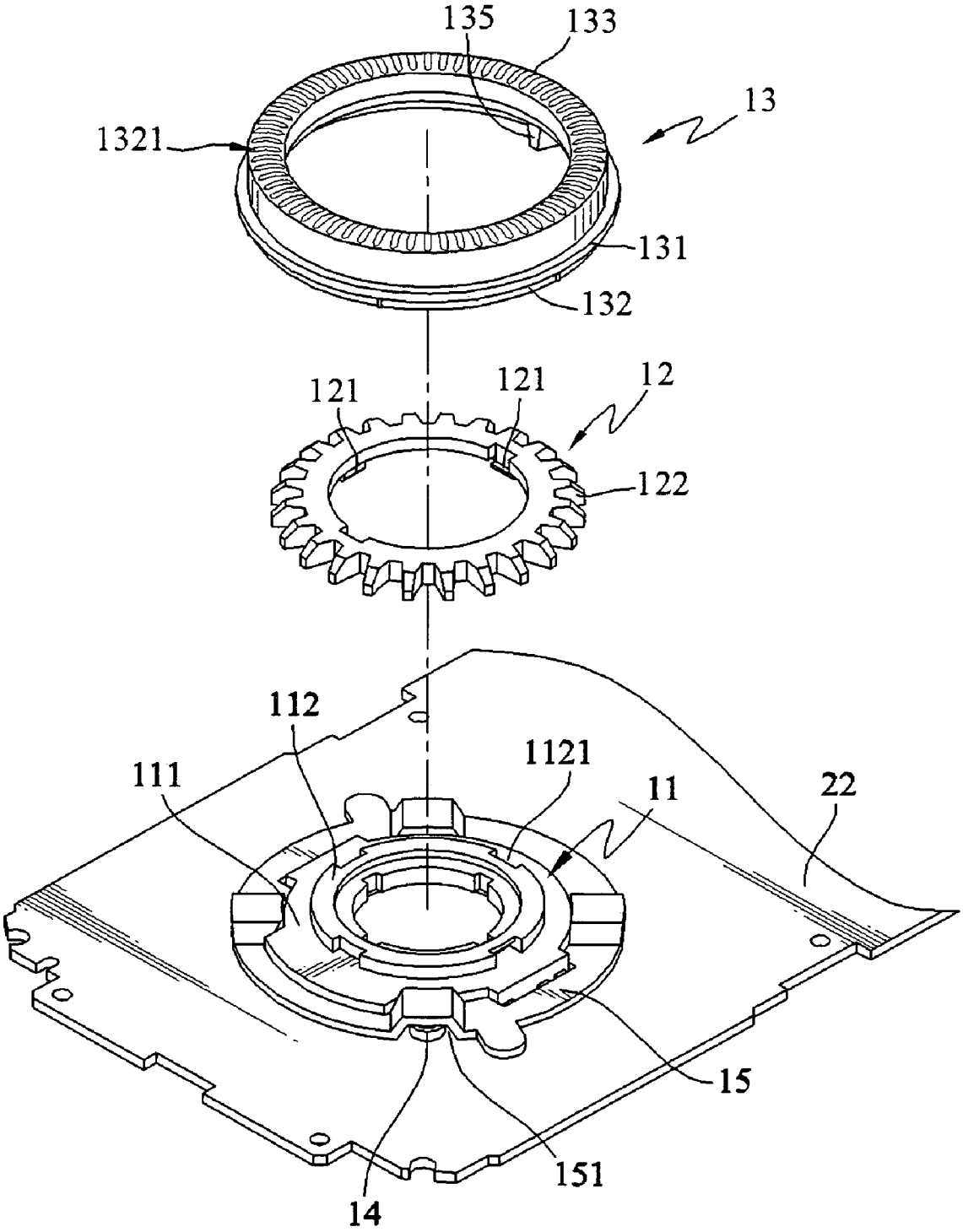
FIG. 3 is another exploded schematic view of the structure of the present invention.

Referring to FIG. 3, the knob structure disclosed by the present invention comprises a rotary encoder 11, a plurality of light emitting sources 14, a light guiding ring 15, a brake wheel 12, and a rotary wheel 13. The rotary encoder 11 at least comprises a fixing base 111 and a rotary ring 112, wherein the rotary ring 112 rotates on the fixing base 111 and generates a pulse signal, and the rotary ring 112 rotates in a stepped manner on the fixing base 111, so as to generate fragmental tactility when the user controls the rotation. The specific structural composition of the rotary encoder 11 and the operating principle have been described in Japan Patent No. 2000297077 and will not be described any more here. A plurality of locking slots 1121 is disposed in the rotary ring 112.

The plurality of light emitting sources 14 is light emitting diodes (LEDs) or other similar light emitting components. The light emitting sources 14 are disposed on the circuit board 22 and arranged around the circumference of the rotary encoder 11, wherein lights are generated when the light emitting sources are powered on.

The light guiding ring 15 has the shape of a ring, the inner diameter of which is larger than the outer diameter of the rotary encoder 11. A plurality of grooves 151 corresponding to the light emitting sources 14 are disposed on the bottom of the light guiding ring 15, such that the light guiding ring 15 can be just disposed on the outer edge of the rotary encoder 11 and covered on the light emitting sources 14. The material of the light guiding ring 15 is a light transmissive material capable of diffusing lights. The centralized lights emitted by the light emitting sources 14 are diffused to be uniformized after entering the light guiding ring 15.

The brake wheel 12 is a ringed formation made of a light transmissive material, the inner diameter of which is about equal to that of the rotary ring 112. A plurality of wedges 121 corresponding to the locking slots 1121 is disposed on the brake wheel 12. As shown in FIG. 3, through embedding the wedges 121 into the locking slots 1121, the brake wheel 12 is fixedly combined with rotary ring 112, so as to drive the rotary ring 112 to rotate on the fixing base 111. Additionally, a plurality of ratchets 122 is disposed around the circumference of the brake wheel 12.

The rotary wheel 13 is a ringed formation made of a transmissive material and comprises a stop ring 131 larger than the outer diameter of the ringed formation. The rotary wheel 13 is separated into an upper part 133 and a lower part 132 by the stop ring 131, wherein the inner diameter of the lower part 132 is slightly greater than the maximum outer diameter (including the height of the ratchet 122) of the brake wheel 12. A block 135 that extends inwards is disposed on the inner edge of the lower part 132, wherein the length of the block 135 is slightly smaller than the height of the ratchet 122. Additionally, anti-slip stripes 1321 are formed on the top surface of the upper part 133.

Figure 4A:
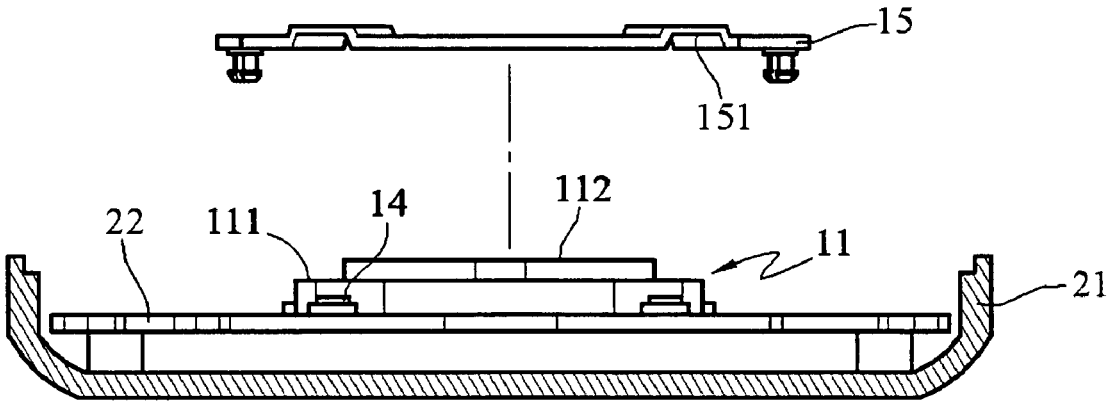
FIGS. 4A and 4B are sectional schematic views of a partial structure of the present invention.
Figure 4B:
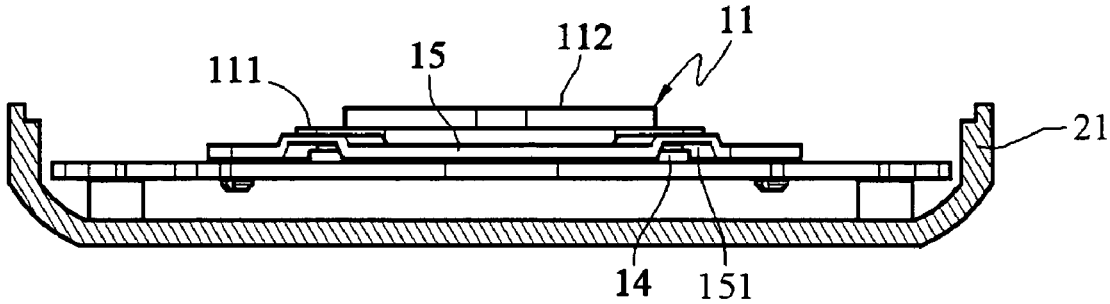
Figure 5A:
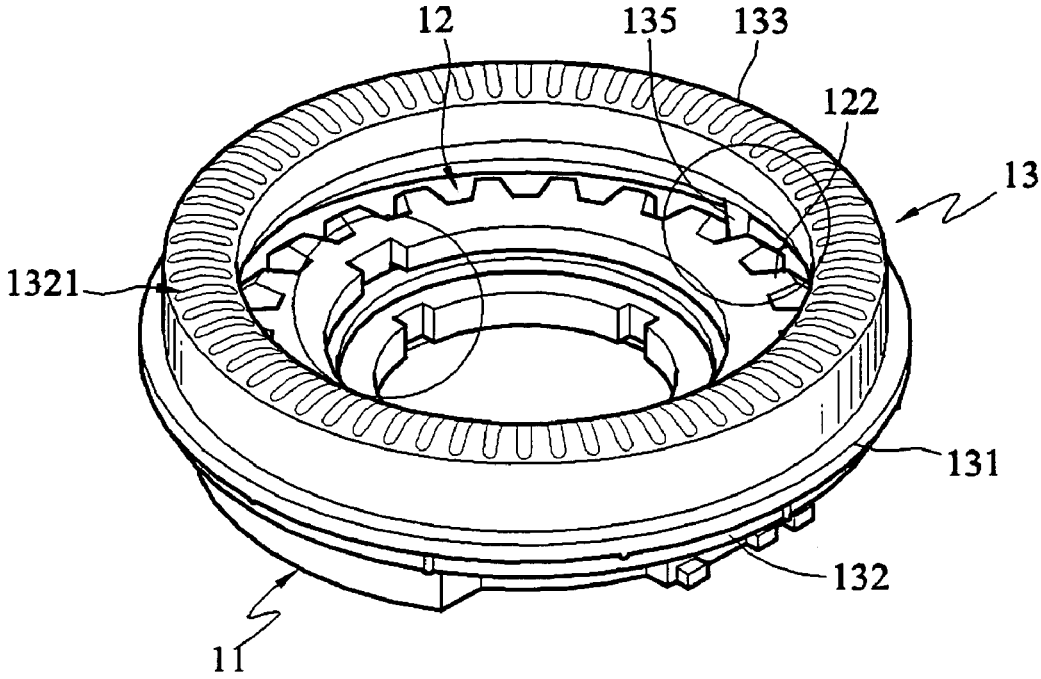
FIGS. 5A, 5B, and 5C are sectional schematic views of a partial structure of the present invention.
Figure 5B:
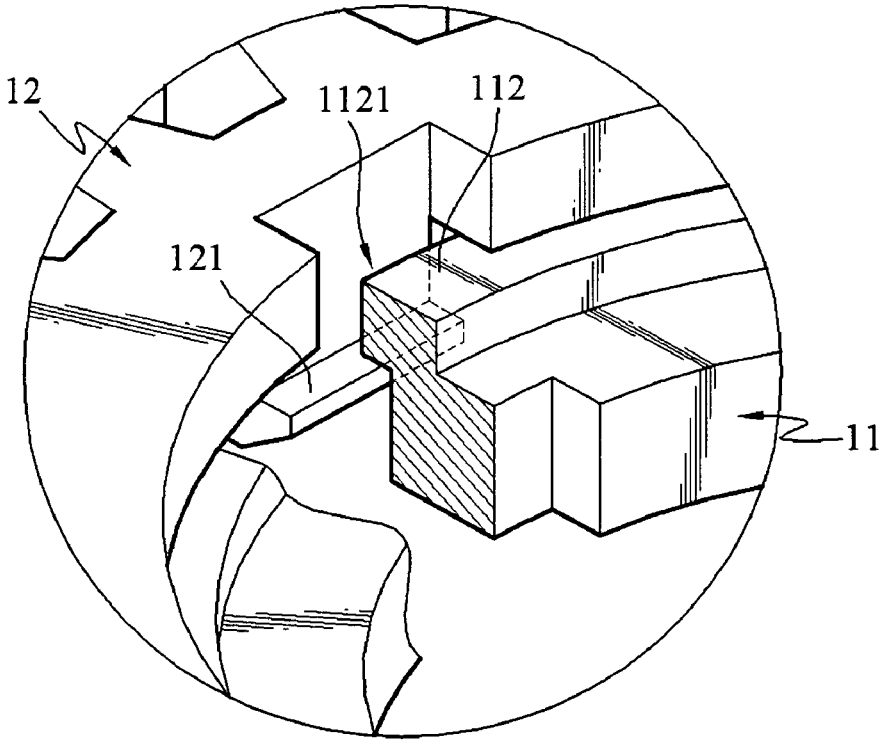
Figure 5C:
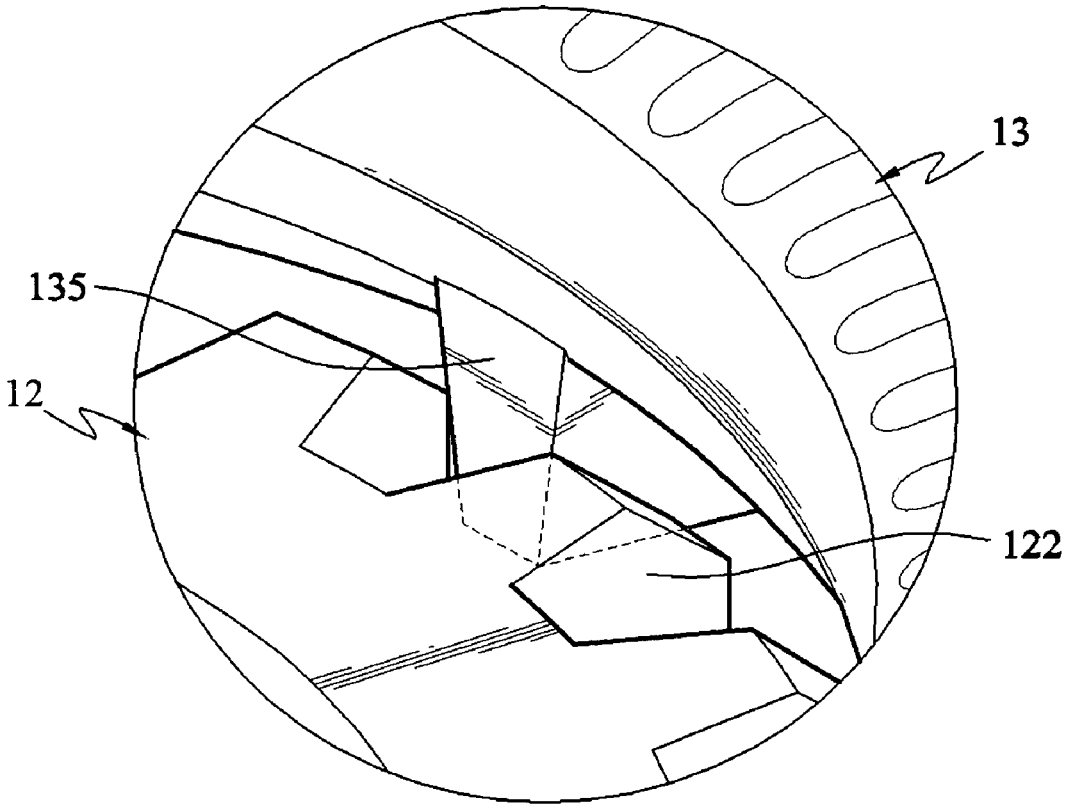

As shown in FIGS. 4A and 4B, firstly, the light guiding ring 15 is disposed on the outer edge of the rotary encoder 11 and covered on the light emitting sources 14. As shown in FIGS. 5A, 5B, and 5C, the brake wheel 12 is embedded into the locking slot 1121 via the wedge 121, so as to fixedly combine with the rotary ring 112. The rotary wheel 13 is nested on the brake wheel 12, and the block 135 is embedded between any two corresponding ratchets 122 of the brake wheel 12, so the rotary wheel 13 is engaged with the brake wheel 12 non-fixedly. When the rotary wheel 13 is controlled to rotate, the brake wheel 12 drives the rotary ring 112 to rotate, such that the rotary encoder 11 generates a preset control signal. The length difference between the block 135 and the ratchet 122 defines the movement margin of the rotary wheel 13 on the brake wheel 12.

Figure 6:
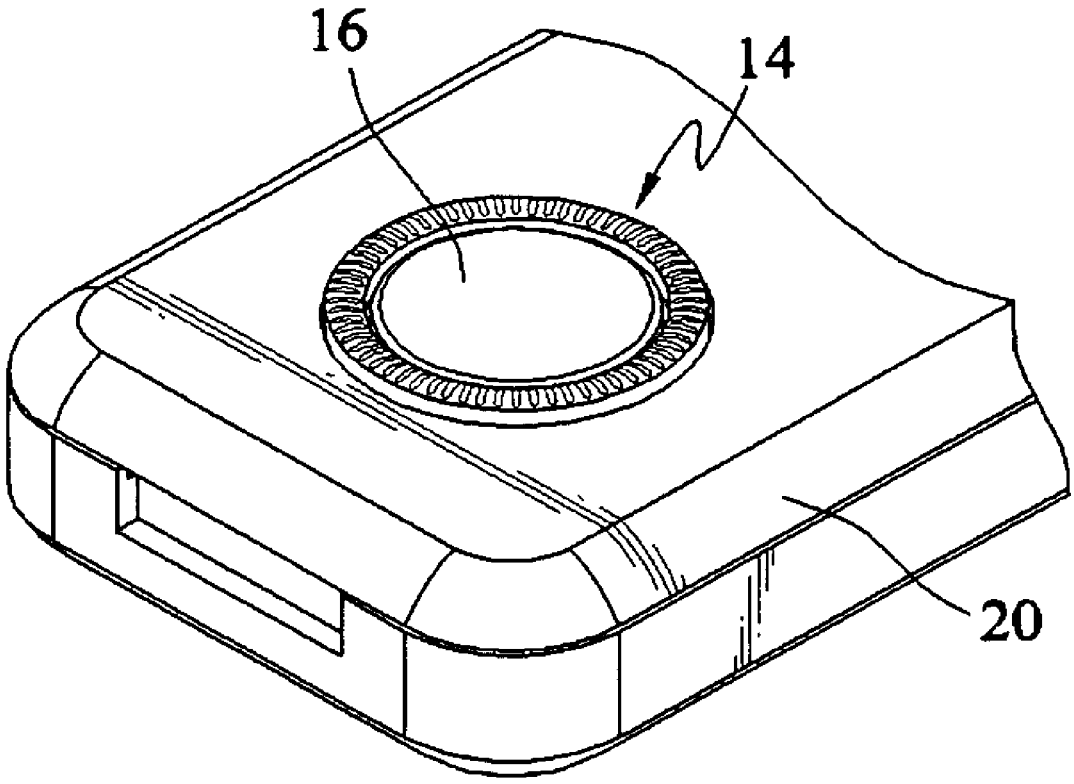
FIG. 6 is a assembly schematic view of the present invention.

Further as shown in FIGS. 2 and 6, the brake wheel 12 is fixedly combined with the rotary ring 112 of the rotary encoder 11, as shown in FIG. 3. Then, the rotary wheel 13 is nested on the brake wheel 12 non-fixedly, with the block 135 of the rotary wheel 13 embedded between any two corresponding ratchets 122 of the brake wheel 12. After that, the round hole 211 of the body case 21 is covered on the circuit board 22 corresponding to the rotary wheel 13, with the stop ring 131 of the rotary wheel 13 against the inner wall of the corresponding round hole 211 of the body case 21. Since the length difference between the block 135 and the ratchet 122 defines the movement margin of the rotary wheel 13 on the brake wheel 12, the round hole 211 of the body case 21 can still smoothly enclose the rotary wheel 13 as long as the assembly error between the body case 21 and the rotary wheel 13 falls within the movement margin. The upper part 133 of the rotary wheel 13 slightly projects from the body case 21, such that the user may press the upper part 133 of the rotary wheel 13 through a finger to control the rotation of the rotary wheel 13 and make the rotary encoder 11 generate the preset control signal when the brake wheel 12 and the rotary ring 112 are driven to rotate.

Through the design of the antis-lip stripes 1321 on the upper part 133 of the rotary wheel 13, the user still may control and rotate the rotary wheel 13 conveniently through a finger. Since the rotary wheel 13 and the brake wheel 12 are engaged non-fixedly, the assembly errors between the rotary encoder 11, the rotary wheel 13, and the body case 21 may be aligned through the movement margin between the ratchets 122 and the block 135, such that the rotary wheel 13 may rotate smoothly on the body case 21. Furthermore, lights from the light emitting sources 14 are emitted outwards after passing through the light guiding ring 15, the brake wheel 12, and the rotary wheel 13, thereby illuminating the rotary wheel 13.

A cover 16 is disposed on the center of the rotary wheel 13 and a switch (not shown) is disposed in a corresponding position of the cover 16, such that the cover 16 is used as a button.

Figure 7A:
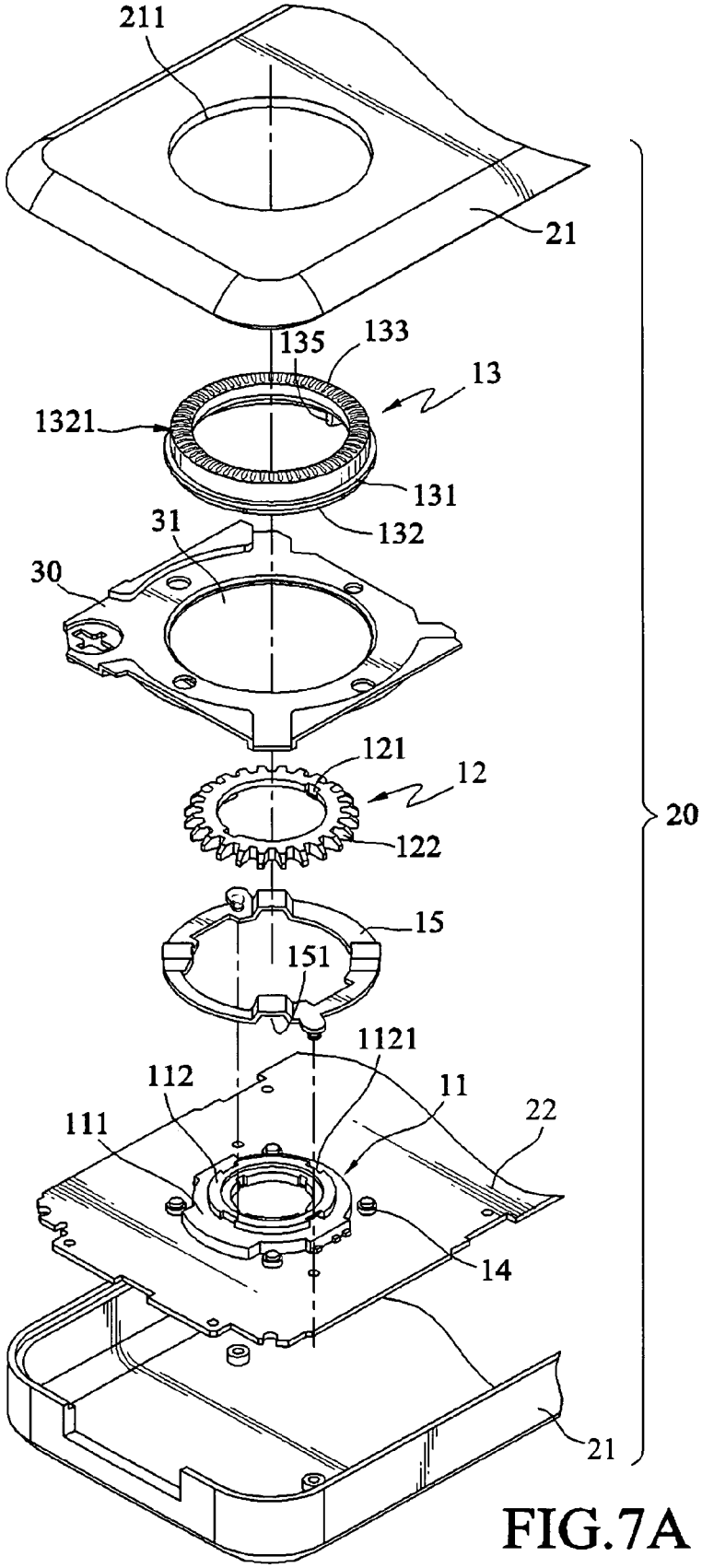
FIGS. 7A and 7B are schematic views of a second embodiment of the present invention.
Figure 7B:
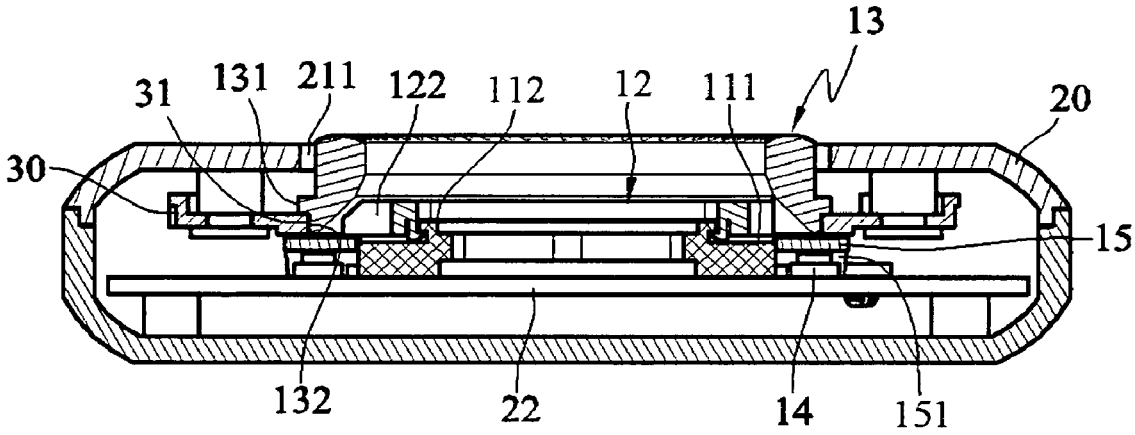

As shown in FIGS. 7A and 7B, it is a schematic view of a second embodiment of the present invention, wherein a tray 30 corresponding to the round hole 211 is provided. A hole 31, the inner diameter of which is slightly smaller than the outer diameter of the lower part 132 of the rotary wheel 13, is formed in the tray 30. The rotary wheel 13 may be firstly nested on the round hole 211 of the body case 21, and then the tray 30 is fixedly combined with the bottom of the body case 21 corresponding to the rotary wheel 13, such that the rotary wheel 13 is rotatably nested on the hole 31. Similarly, the brake wheel 12 is fixedly combined with the rotary ring 112 of the rotary encoder 11. When the body case 21 and the rotary wheel 13 are covered on the circuit board 22 together corresponding to the rotary encoder 11, the block 135 of the rotary wheel 13 is embedded into any two corresponding ratchets 122, such that the rotary wheel 13 and the brake wheel 12 are engaged non-fixedly. As such, the assembly errors between the rotary encoder 11, the rotary wheel 13, and the body case 21 are aligned through the movement margin between the ratchets 122 and the block 135, such that the rotary wheel 13 can smoothly rotate on the body case 21.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A knob structure applied in an electronic device to input more than one control signal into the electronic device, wherein the electronic device has at least one round hole, the knob structure comprising:

a rotary encoder rotated to generate the control signal;

a brake wheel fixed on the rotary encoder to drive the rotary encoder to rotate, wherein a plurality of ratchets is disposed around a circumference of the brake wheel; and a rotary wheel nested on the brake wheel non-fixedly and correspondingly nested on the at least one round hole of the electronic device, wherein a block is disposed in the rotary wheel and embedded between any two of the ratchets, such that the rotary wheel drives the brake wheel to rotate, and a stop ring is disposed on the rotary wheel and an outer diameter of the stop ring is larger than an inner diameter of the at least one round hole.

2. The knob structure as claimed in claim 1, wherein an upper part and a lower part of the rotary wheel are separated by the stop ring, and the block is disposed on an inner edge of the lower part.

3. The knob structure as claimed in claim 2, wherein the upper part of the rotary wheel has anti-slip stripes.

4. A knob structure applied in an electronic device to input more than one control signal into the electronic device, wherein the electronic device has at least one round hole, the knob structure comprising:

a rotary encoder rotated to generate the control signal;

a brake wheel fixed on the rotary encoder to drive the rotary encoder to rotate, wherein a plurality of ratchets is disposed around a circumference of the brake wheel;

a tray with a hole corresponding to the at least one round hole, wherein the tray is fixedly combined into the at least one round hole of the electronic device; and a rotary wheel rotatably disposed on the tray and nested on the at least one round hole of the electronic device, wherein the rotary wheel is nested on the brake wheel non-fixedly, and a block is disposed in the rotary wheel and embedded between any two of the ratchets, such that the rotary wheel drives the brake wheel to rotate.

5. The knob structure as claimed in claim 4, wherein the rotary encoder comprises a fixing base and a rotary ring, and the brake wheel is fixedly combined with the rotary ring.

6. The knob structure as claimed in claim 5, wherein a plurality of locking slots is disposed on the rotary ring and a plurality of wedges corresponding to the locking lots is disposed on the brake wheel.

7. The knob structure as claimed in claim 4, wherein a stop ring is disposed on the rotary wheel and an outer diameter of the stop ring is larger than an inner diameter of the round hole.

8. The knob structure as claimed in claim 7, wherein an upper part and a lower part of the rotary wheel are separated by the stop ring, and the block is disposed on an inner edge of the lower part.

9. The knob structure as claimed in claim 8, wherein the upper part of the rotary wheel has anti-slip stripes.

10. The knob structure as claimed in claim 4, wherein a length difference between the block and the plurality of ratchets define the movement margin of the rotary wheel on the brake wheel.

11. The knob structure as claimed in claim 4, wherein an inner diameter of the at least one round hole is smaller than an outer diameter of a lower part of the rotary wheel.

* * * * *